US007500547B2

(12) United States Patent
Bettua et al.

(10) Patent No.: US 7,500,547 B2
(45) Date of Patent: Mar. 10, 2009

(54) COLLAPSIBLE EXPANDING LUGGAGE

(75) Inventors: Michael Bettua, Hoboken, NJ (US); Kiran Joseph, Chennai (IN); Rachel Matthai, Hoboken, NJ (US)

(73) Assignee: Max Mirani LLC, Hoboken, NJ (US)

( * ) Notice: Subject to any disclaimer, the term of this patent is extended or adjusted under 35 U.S.C. 154(b) by 286 days.

(21) Appl. No.: 11/464,313

(22) Filed: Aug. 14, 2006

(65) Prior Publication Data

US 2008/0047792 A1 Feb. 28, 2008

(51) Int. Cl.
*B65D 13/00* (2006.01)

(52) U.S. Cl. ..... 190/115; 190/18 A; 190/103; 190/107; 190/127; 190/114; 190/112; 190/113

(58) Field of Classification Search ..... 190/107, 190/103–105; 229/101, 117.01
See application file for complete search history.

(56) References Cited

U.S. PATENT DOCUMENTS

| | | | | |
|---|---|---|---|---|
| 21,381 | A | 8/1858 | Timby | |
| 21,384 | A | 8/1858 | Timby | |
| 736,871 | A | 8/1903 | O'Brien | |
| 952,911 | A * | 3/1910 | Kukuruda | 229/117.07 |
| 1,636,838 | A | 7/1927 | Roser | |
| D94,708 | S | 2/1935 | Piffath | |
| 2,018,809 | A | 10/1935 | Rodgers | |
| 2,136,669 | A | 11/1938 | Bracken | |
| 2,425,035 | A | 8/1947 | Garnett | |
| D147,825 | S | 11/1947 | Wemyss | |
| 2,461,482 | A | 2/1949 | Schaus | |
| 2,538,616 | A | 1/1951 | Cross | |
| 3,031,121 | A * | 4/1962 | Chase | 383/13 |
| D194,140 | S | 11/1962 | Weintraub | |
| D202,602 | S | 10/1965 | Armbruster | |
| D217,107 | S | 4/1970 | Cassidy | |
| 3,647,035 | A | 3/1972 | Honig | |
| 4,128,150 | A | 12/1978 | Popkin | |
| 4,160,496 | A | 7/1979 | Knight | |
| 4,773,515 | A * | 9/1988 | Kotkins, Jr. | 190/103 |
| 4,984,662 | A | 1/1991 | Jacober | |
| 5,289,906 | A * | 3/1994 | Guidi | 190/107 |
| 5,450,629 | A * | 9/1995 | Gilstrap | 2/209.11 |
| 5,918,711 | A | 7/1999 | Godshaw | |
| D435,967 | S | 1/2001 | Tiramani | |
| D441,161 | S | 4/2001 | Shetterly | |
| 6,244,399 | B1 | 6/2001 | Burkestrand | |
| 6,302,250 | B1 | 10/2001 | Sadow | |
| 6,408,443 | B1 * | 6/2002 | Park | 2/195.1 |
| 6,443,274 | B1 | 9/2002 | Klamm | |
| 6,502,677 | B1 * | 1/2003 | Tiramani et al. | 190/127 |
| 6,604,617 | B2 | 8/2003 | Davis | |
| 6,609,598 | B2 | 8/2003 | Hsu | |
| 6,926,129 | B2 | 8/2005 | Hoberman | |
| 6,955,365 | B2 | 10/2005 | Giampavolo | |

(Continued)

*Primary Examiner*—Tri M Mai
(74) *Attorney, Agent, or Firm*—PatentBest; Andrew McAleavey

(57) ABSTRACT

A collapsible piece of luggage is disclosed. The piece of luggage may have wheels and an extendable and retractable handle. The sidewall, bottom and cover of the luggage have sufficient rigidity to hold their own shape and may be folded into a storage configuration in which the piece of luggage is smaller in width and depth. Additionally, the luggage includes an expansion feature that allows the luggage cover to expand outward pyramidally so as to increase the storage volume of the luggage.

20 Claims, 12 Drawing Sheets

U.S. PATENT DOCUMENTS

2004/0007433 A1 1/2004 Godshaw
2004/0144606 A1 7/2004 Han
2005/0034947 A1 2/2005 Nykoluk
2005/0034948 A1 2/2005 Tiramani
2005/0224304 A1 10/2005 Bhavnani
2005/0284718 A1 12/2005 Tai
2007/0074941 A1 * 4/2007 Liang ..... 190/107

* cited by examiner

COLLAPSIBLE EXPANDING LUGGAGE

BACKGROUND OF THE INVENTION

1. Field of the Invention

The invention generally relates to luggage, and more particularly to collapsible expanding luggage.

2. Description of Related Art

Travel has increasingly become a part of modem life. In today's highly interconnected world, many executives travel thousands of miles a year attending to business. Leisure travel has increased as well, and many people now consider vacations and other trips of a scope and duration that would have been unheard of in the past.

Most travelers use luggage to store and protect their possessions while traveling. Many different types of luggage are in use today, including conventional hard-sided and soft-sided suitcases, duffel bags, garment bags, and upright roller travel bags. Of the conventional types of luggage, upright roller travel bags, which are suitcases that have integrated wheels and an integrated rigid, telescoping handle, have become particularly popular because they can be wheeled easily from place to place, are stable and easily controlled while in motion, and have handles that conveniently collapse into the bag.

One problem with conventional luggage is that when it is not in use, it often takes quite a bit of space to store. Even luggage sets, which allow smaller pieces of luggage to be stored inside larger ones, still require enough space to store the largest piece. However, storage space is often at a premium, making luggage storage an inconvenient hassle.

There have been some attempts to create collapsible luggage, so as to minimize the amount of storage space that the luggage consumes. However, the collapsible luggage that has reached the market is largely of the soft-sided sort. The walls of soft-sided luggage generally do not have sufficient rigidity to hold their own shape, which can make loading soft-sided luggage more difficult, and can also adversely affect the ability of soft-sided luggage to protect its contents. Perhaps for these reasons, soft-sided luggage generally does not have the consumer appeal that conventional hard-sided and semi-firm luggage does.

In some cases, reinforcing bars have been added to soft-sided luggage to create some rigidity while preserving the ability of the luggage to collapse. For example, U.S. Pat. No. 6,443,274 to Klamm discloses a soft-sided bag that includes metal stays in the sidewalls. However, the stays do not reinforce the entirety of the sidewalls, and despite the presence of the stays, the bag is still soft-sided. Moreover, in general, the more rigid the sidewalls of the luggage are, the more difficult it is to make the luggage collapse into a compact form for storage.

SUMMARY OF THE INVENTION

One aspect of the invention relates to a piece of luggage. The piece of luggage has a bottom panel; left, right, upper, and lower sidewall portions; and a cover. The bottom panel has at least one rigid portion. The left, right, upper and lower sidewall portions are connected to one another so as to form a generally contiguous sidewall connected to the bottom panel and extending outwardly therefrom. The sidewall has sufficient rigidity to hold its own shape. The sidewall and bottom panel together define a storage volume. The cover is sized to cover and close the storage volume defined by the sidewall and bottom panel and is attached to at least one of the sidewall portions so as to be moveable between an open position, in which the storage volume can be accessed, and a closed position, in which the storage volume is closed. The cover, sidewall, and back have fold lines in predefined positions such that the piece of luggage can be folded into a storage configuration in which the sidewall, the cover, and portions of the bottom panel are folded into an area defined by the at least one rigid portion of the bottom panel.

In some embodiments, the piece of luggage may further comprise an extendable and retractable handle and one or more wheels. The handle is provided within the at least one rigid portion of the bottom panel and is connected thereto so as to be moveable between an extended position, in which the handle extends beyond the at least one rigid portion, and a retracted position, in which the handle is substantially within the at least one rigid portion. The one or more wheels are attached to the exterior of the lower sidewall portion or the bottom panel.

Another aspect of the invention relates to a piece of luggage. The piece of luggage has a bottom panel; left, right, upper, and lower sidewall portions; and a cover. The bottom panel has at least one rigid portion. The left, right, upper and lower sidewall portions are connected to one another so as to form a generally contiguous sidewall connected to the bottom panel and extending outwardly therefrom. The sidewall has sufficient rigidity to hold its own shape. The sidewall and bottom panel together define a storage volume. The cover is sized to cover and close the storage volume defined by the sidewall and bottom panel and is attached to at least one of the sidewall portions so as to be moveable between an open position, in which the storage volume can be accessed, and a closed position, in which the storage volume is closed. The cover includes a plurality of geometrically-shaped segments pivotally connected to outer edges of the cover and connected to one another by gusset material toward the interior of the cover such that the cover is capable of assuming two configurations, an unexpanded configuration in which the geometrically-shaped segments are all generally coplanar, and an expanded configuration in which the geometrically-shaped segments are non-coplanar and project outwardly so as to add to the storage volume. The cover, sidewall, and back have fold lines in predefined positions such that the piece of luggage can be folded into a storage configuration in which the sidewall, the cover, and portions of the bottom panel are folded into an area defined by the at least one rigid portion of the bottom panel.

In some embodiments, the piece of luggage may further comprise an extendable and retractable handle and one or more wheels. The handle is provided within the at least one rigid portion of the bottom panel and is connected thereto so as to be moveable between an extended position, in which the handle extends beyond the at least one rigid portion, and a retracted position, in which the handle is substantially within the at least one rigid portion. The one or more wheels are attached to the exterior of the lower sidewall portion or the bottom panel.

Yet another aspect of the invention relates to a piece of luggage. The piece of luggage has a bottom panel; left, right, upper, and lower sidewall portions; and a cover. The bottom panel has at least one rigid portion. The left, right, upper and lower sidewall portions are connected to one another so as to form a generally contiguous sidewall connected to the bottom panel and extending outwardly therefrom. The sidewall has sufficient rigidity to hold its own shape. The sidewall and bottom panel together define a storage volume. The cover is sized to cover and close the storage volume defined by the sidewall and bottom panel and is attached to at least one of the sidewall portions so as to be moveable between an open position, in which the storage volume can be accessed, and a closed position, in which the storage volume is closed. The cover includes a plurality of geometrically-shaped segments pivotally connected to outer edges of the cover and connected to one another by gusset material toward the interior of the cover such that the cover is capable of assuming two configurations, an unexpanded configuration in which the geometrically-shaped segments are all generally coplanar, and an expanded configuration in which the geometrically-shaped segments are non-coplanar and project outwardly so as to add to the storage volume.

In some embodiments, the piece of luggage may further comprise a rigid portion attached to the exterior of the bottom panel, an extendable and retractable handle and one or more wheels. The handle is provided within the at least one rigid portion of the bottom panel and is connected thereto so as to be moveable between an extended position, in which the handle extends beyond the at least one rigid portion, and a retracted position, in which the handle is substantially within the at least one rigid portion. The one or more wheels are attached to the exterior of the lower sidewall portion or the bottom panel.

These and other aspects, features, and advantages of the invention will be set forth in the detailed description that follows.

BRIEF DESCRIPTION OF THE DRAWINGS

The invention will be described with respect to the following drawing figures, in which like numerals represent like features throughout the figures, and in which.

DETAILED DESCRIPTION

Figure 1:
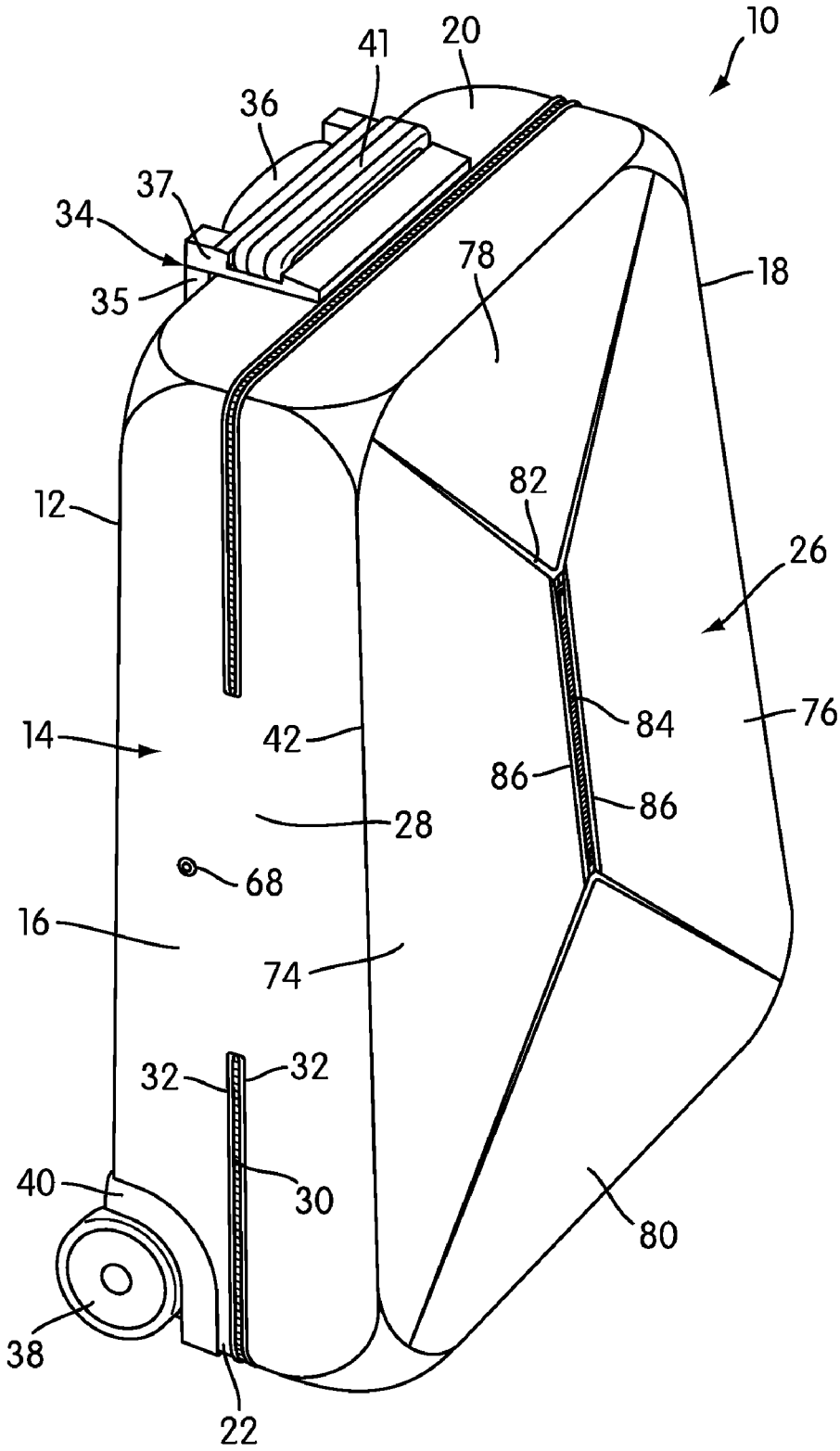
FIG. 1 is a perspective view of a piece of collapsible luggage according to one embodiment of the invention.

FIG. 1 is a perspective view of a piece of luggage, generally indicated at 10. For convenience in the description of the piece of luggage 10 that follows, certain directional terms, such as "left," "right," "upper," and "lower," are given with respect to the coordinate system of the drawing figures, unless otherwise indicated. For example, the term "left" will generally refer to the feature found on the left side of the drawing figure.

Figure 2:
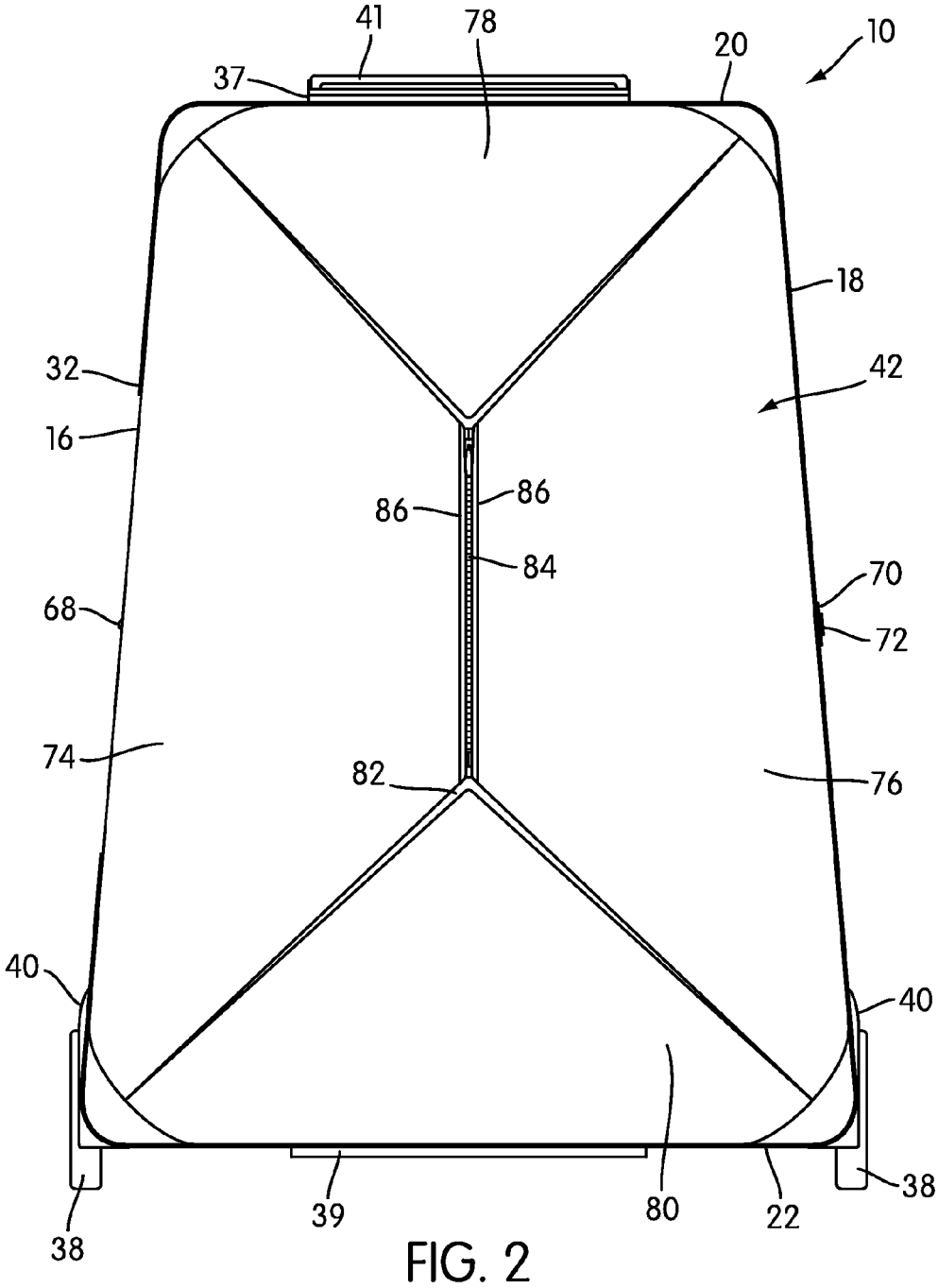
FIG. 2 is a front elevational view of the piece of collapsible luggage of FIG. 1, illustrating its expansion panel in an unexpanded configuration.
Figure 3:
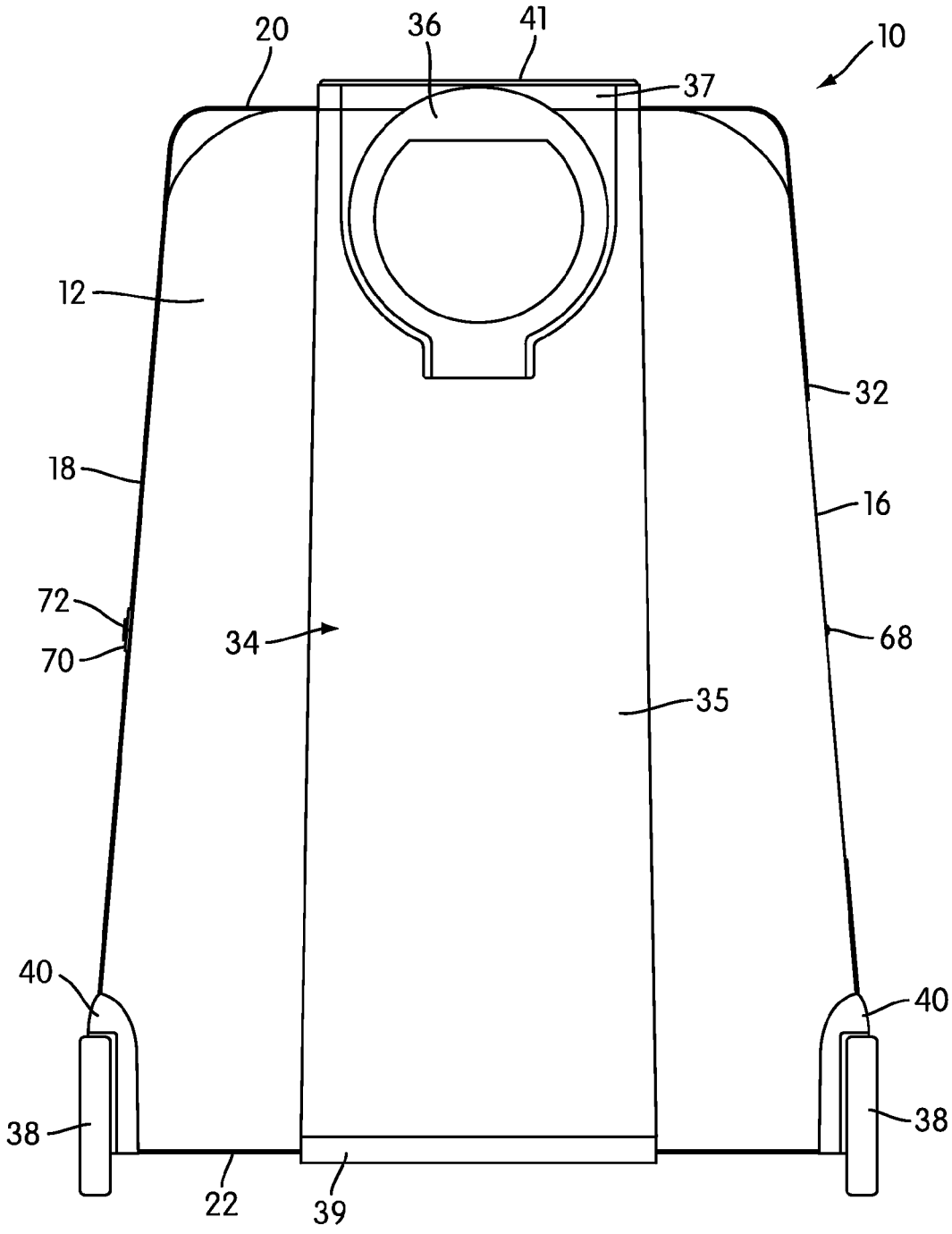
FIG. 3 is a rear elevational view of the piece of collapsible luggage of FIG. 1.
Figure 4:
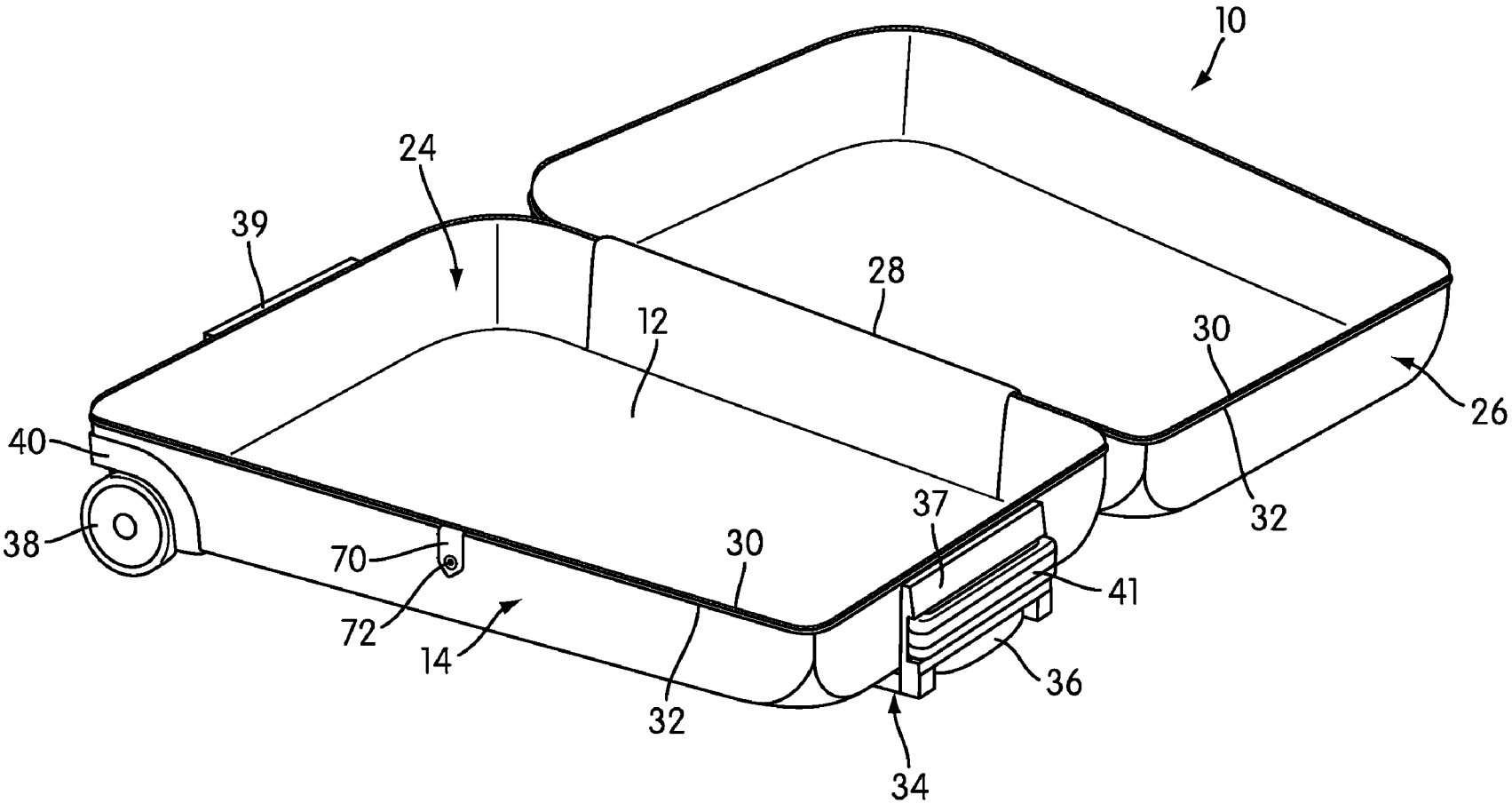
FIG. 4 is a perspective view of the piece of collapsible luggage of FIG. 1 in an open configuration.

FIGS. 2 and 3 are front and rear elevational views of the piece of luggage, and FIG. 4 is a perspective view of the piece of luggage in an open configuration. The piece of luggage 10 has a bottom panel 12, which may also be referred to as a back panel. Connected to and extending outwardly from the bottom panel 12 is a generally contiguous sidewall 14, which is comprised of left 16, right 18, upper 20 and lower 22 sidewall portions. The sidewall 14 has sufficient rigidity to hold its own shape and, with the bottom panel 12, defines a storage volume 24 in its interior.

A cover 26 is sized and adapted to mate with the sidewall 14 so as to cover the storage volume 24 and close the piece of luggage 10. As shown, the cover 26 of the illustrated embodiment has depth and thus adds to the storage volume 24, although in some embodiments, the cover 26 may not have significant depth, and thus, may not contribute significantly to the storage volume 24 of the piece of luggage 10. As shown in the figures, the cover 26 is connected to at least one of the sidewall portions 16, 18, 20, 22 (in the illustrated embodiment, the cover 26 is connected to the left sidewall portion 16) so as to define a hinge area 28 of flexible material, using which the cover 26 can be moved between the closed position of FIG. 1 and the open position of FIG. 4. A zipper 30 releasably connects the cover 26 to the other three sidewall portions 18, 20, 22. Depending on the embodiment, the zipper 30 may be concealed or partially concealed by fabric piping 32 or other concealing features.

Because of the depth of the depth of the cover 26, the piece of luggage 10 has an overall clamshell shape, which is best seen in FIG. 4, the perspective view of the piece of luggage 10 in the open configuration. If the cover 26 in the illustrated embodiment defines parts of the sidewall 14, those portions of the sidewall also have sufficient rigidity to hold their own shape. The cover 26 of the illustrated embodiment also includes an expanding feature, which will be described in more detail below, although in other embodiments, the cover 26 may not include an expanding feature.

Attached to a portion of the exterior of the bottom panel 12 and forming a C-shape such that it also attaches to the upper and lower portions 20, 22 of the sidewall 14 is a rigid portion 34. In the illustrated embodiment, the rigid portion 34 covers approximately the central third of the bottom panel 12 and similar areas on the upper and lower 22 sidewall portions. The rigid portion 34 may be attached to the piece of luggage 10 using adhesives, rivets, or any other conventional fastening means, and, if desired, portions of the bottom panel 12 may be molded, shaped or contoured to accommodate the rigid portion 34 and its components. Moreover, the rigid portion 34 may be molded or formed as a single piece, or it may be formed in several sections that are fastened together. For example, as can best be seen in FIG. 3, the rigid portion 34 of the illustrated embodiment is divided into a central portion 35 that extends along the bottom panel 12, a perpendicular upper portion 37 that extends along the upper sidewall portion 20 and a perpendicular lower portion 39 that extends along the lower sidewall portion 22. Typically, the rigid portion 34 would be made of a material that has some degree of stiffness, abrasion resistance, and impact resistance. Plastics made from acrylonitrile-butadiene-styrene copolymers (ABS plastics) are good materials to use for the rigid portion 34. However, those of skill in the art may select other materials for use, including lightweight metals, such as aluminum, other plastics, and various types of wood.

The piece of luggage 10 is most advantageously an upright roller-type travel bag. An extendable and retractable handle 36 is within the rigid portion 34 and/or portions of the bottom panel 12 and is connected internally to the rigid portion 34. The handle 36 is movable between an extended position (not shown in the figures) in which it extends beyond the rigid portion 34 and can be grasped to move the piece of luggage 10, and a retracted position, shown in FIG. 3 and the other figures, in which it is substantially within the rigid portion 34. Many telescoping mechanisms are known in the art, and any of these may be applied to pieces of luggage 10 according to the present invention. Furthermore, the handle 36 and the shaft to which it is attached may be plastic, metal, a combination of plastic and metal, or some other material. The handle 36 and shaft may be of the same or different materials. The handle 36 may have any contours or gripping features that increase the ability of a user to grip it. A secondary, non-telescoping lifting handle 41 is attached to the upper portion 37 of the rigid portion 34. In other embodiments, other handles may be attached to other parts of the piece of luggage 10 in order to facilitate lifting and handling.

Additionally, the bottom and lower panels 12, 22 include a set of wheels 38 connected to corresponding wheel well and axle assemblies 40. Depending on the embodiment, there may be more than two wheels 38, or a single, elongate roller wheel may be provided. Generally, the wheels 38 would be made from plastic, rubber or another material suitable for the application. The wheel well assemblies 40 would be made of the same materials from which the rigid portion 34 is made, although the materials may be different in some embodiments. If desired, the wheels 38 may be provided with rubber circumferences or "tires" to aid in traction.

Thus, the piece of luggage 10 of the illustrated embodiment is an upright roller travel bag with wheels 38 and an expandable and retractable handle 36, although the handle 36 and wheels 38 may be optional features in some embodiments.

The piece of luggage 10 of the illustrated embodiment also has a slightly trapezoidal overall shape, with a longer lower sidewall portion 22, although it may have a rectangular shape, a square shape, or any other shape compatible with the collapsing features described below. If present, the slightly trapezoidal overall shape may contribute to the stability of the piece of luggage 10 during movement because of its wider base, and it also adds to the characteristic look of the piece of luggage 10.

The piece of luggage 10 may have any desired size, and pieces of luggage 10 may be constructed in a variety of sizes so as to provide greater and lesser storage volumes 24. One exemplary size is approximately 24 inches long, 18 inches wide at the widest point, and approximately 9 inches deep (approximately 61 centimeters by 43 centimeters by 23 centimeters).

The materials used to make the piece of luggage 10 may vary from embodiment to embodiment, there may be several layers of material, and different materials may be used for different portions of the piece of luggage 10, depending on the forces or stresses to which those particular portions are subjected during use. Those of skill in the art will be able to select appropriate materials, depending on the application for which the piece of luggage is designed, the anticipated end user, the desired cost, and other factors.

For example, in one embodiment, the sidewall 14, bottom panel 12, and cover 26 may be made of layers of ballistic nylon backed by internal sheets of, for example, polypropylene plastic 1-2 mm thick. Poly(vinyl chloride) (PVC) sheets and foams of appropriate densities may also be used as internal stiffeners. The thickness of plastic between the outer layers of fabric would give the sidewall 14, bottom panel 12, and cover 26 sufficient rigidity to hold their own shape.

In other embodiments, any suitable sort of metal, plastic, or other rigid material may be used for reinforcing panels. Other suitable plastics may include high density polyethylene (HDPE) or ABS plastic, and suitable metals would include sheets of aluminum and steel. Other fabrics that may be used in the construction of a piece of luggage 10 according to embodiments of the invention include CORDURA® and other types of nylon, polyester, cotton canvas, leather, and polyurethane, to name a few. The innermost layer of fabric, which covers the interior of the storage volume 24, may be a microsuede or a high-sheen nylon, to name two options.

Alternatively, in some embodiments, the materials of which the sidewall 14, bottom panel 12, and cover 26 are made may have sufficient rigidity to hold their own shape without additional reinforcement. Examples of such materials include ethylene-vinyl acetate copolymer foams (EVA foams) of appropriate densities, ABS plastic, carbon fiber composite, and other such materials. In some embodiments, for decorative and/or structural purposes, the exterior of the piece of luggage 10 may be constructed of several layers. For example, the exterior of a piece of luggage 10 could be constructed of EVA foam with an overlaid nylon mesh. Of course, even if the material from which the sidewall 14, bottom panel 12 and cover 26 is made has significant rigidity, reinforcing panels, such as those described above, may be added if desired.

In addition to the primary constituents of the sidewall 14, bottom panel 12, and cover 26, additional material may be adhered to certain areas to resist abrasion, wear, or mechanical stresses. For example, ABS plastic, leather, rubber, or additional ballistic nylon sheets may be adhered to lower external portions of the cover 26 and to the lower portion 22 of the sidewall 14, if desired, in order to reinforce those sections so as to better resist abrasion or applied loads.

One advantage of the piece of luggage 10 is that although it is a rigid- or semi-firm sided bag, it is capable of collapsing into a storage configuration in which the sidewall 14, the cover 26, and portions of the bottom panel 12 are folded into an area defined by the rigid portion 34. As will be explained below and illustrated in the accompanying drawing figures, the piece of luggage 10 is capable of collapsing in two dimensions, such that the piece of luggage 10 in the storage configuration is smaller in width and depth than the piece of luggage 10 when not in the storage configuration.

In order to facilitate transition into the storage configuration, the bottom panel 12, the sidewall 14 and the cover 26 have fold lines in pre-defined positions. These fold lines may be defined by or coincide with sections of unreinforced, flexible fabric between adjacent reinforced sections. Alternatively, if the piece of luggage 10 is constructed of larger, contiguous sheets of relatively rigid material that need no reinforcement, the fold lines could be defined by or coincide with thinner sections of the material that act as flexible living hinges between thicker, more rigid portions of the contiguous sheet. Either or both types of fold lines may be used in the same piece of luggage 10.

Figure 5:
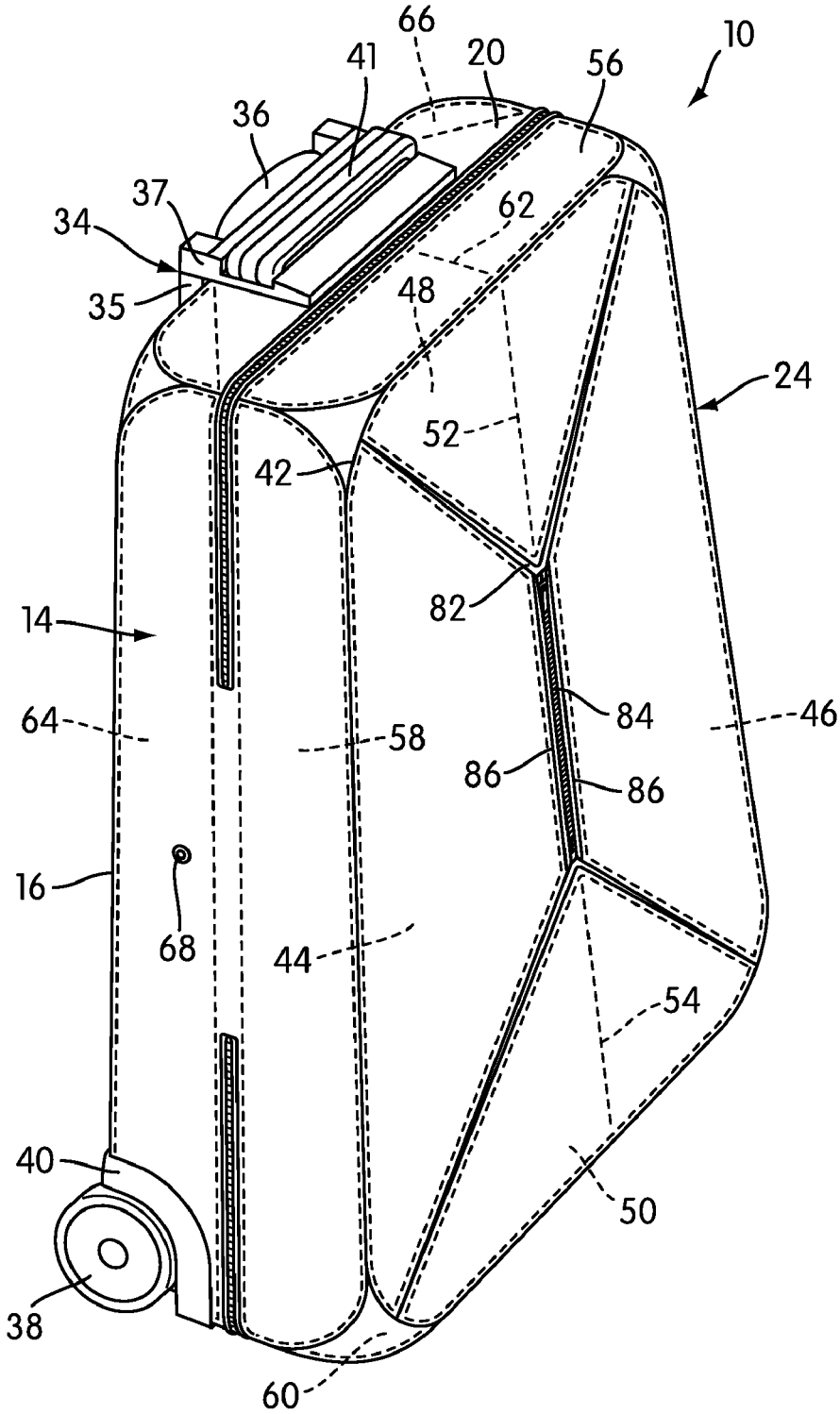
FIG. 5 is a perspective view of the piece of collapsible luggage of FIG. 1, illustrating the location and shape of various reinforcing plates and structures.

FIG. 5 is a perspective view of the piece of luggage 10 that is similar to the perspective view of FIG. 1. FIG. 5 illustrates an embodiment of the piece of luggage 10 in which reinforcing structure, such as polypropylene or PVC plates and structures, is positioned between internal and external layers of fabric or other material. The extent of the reinforcing structure is shown in dotted lines in FIG. 5.

Figure 6:
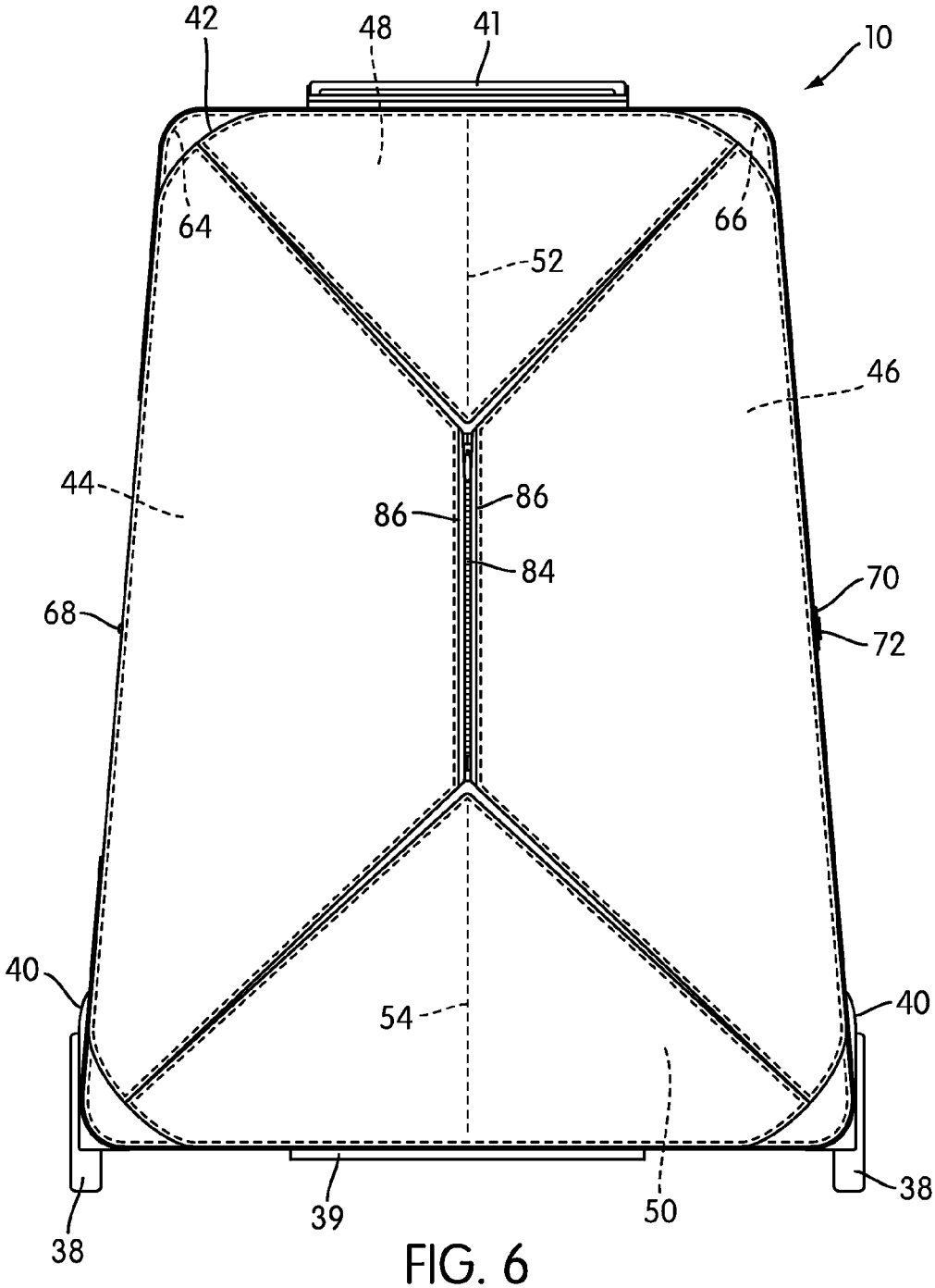
FIG. 6 is a front elevational view of piece of collapsible luggage, illustrating the reinforcing plates of the cover, according to one embodiment.

FIG. 6 is an elevational view of the front portion 42 of the cover 26, illustrating its reinforcing structure in dotted lines. As shown in FIGS. 5 and 6, the front portion 42 of the cover 26 in the illustrated embodiment has four reinforcing plates: a left trapezoidal reinforcing plate 44, a right trapezoidal reinforcing plate 46, an upper triangular reinforcing plate 48, and a lower triangular reinforcing plate 50. Additionally, the upper and lower reinforcing plates 48, 50 each have an additional living hinge 52, 54 that acts as a fold line and subdivides the larger reinforcing plates 48, 50 into two smaller sections.

Figure 7:
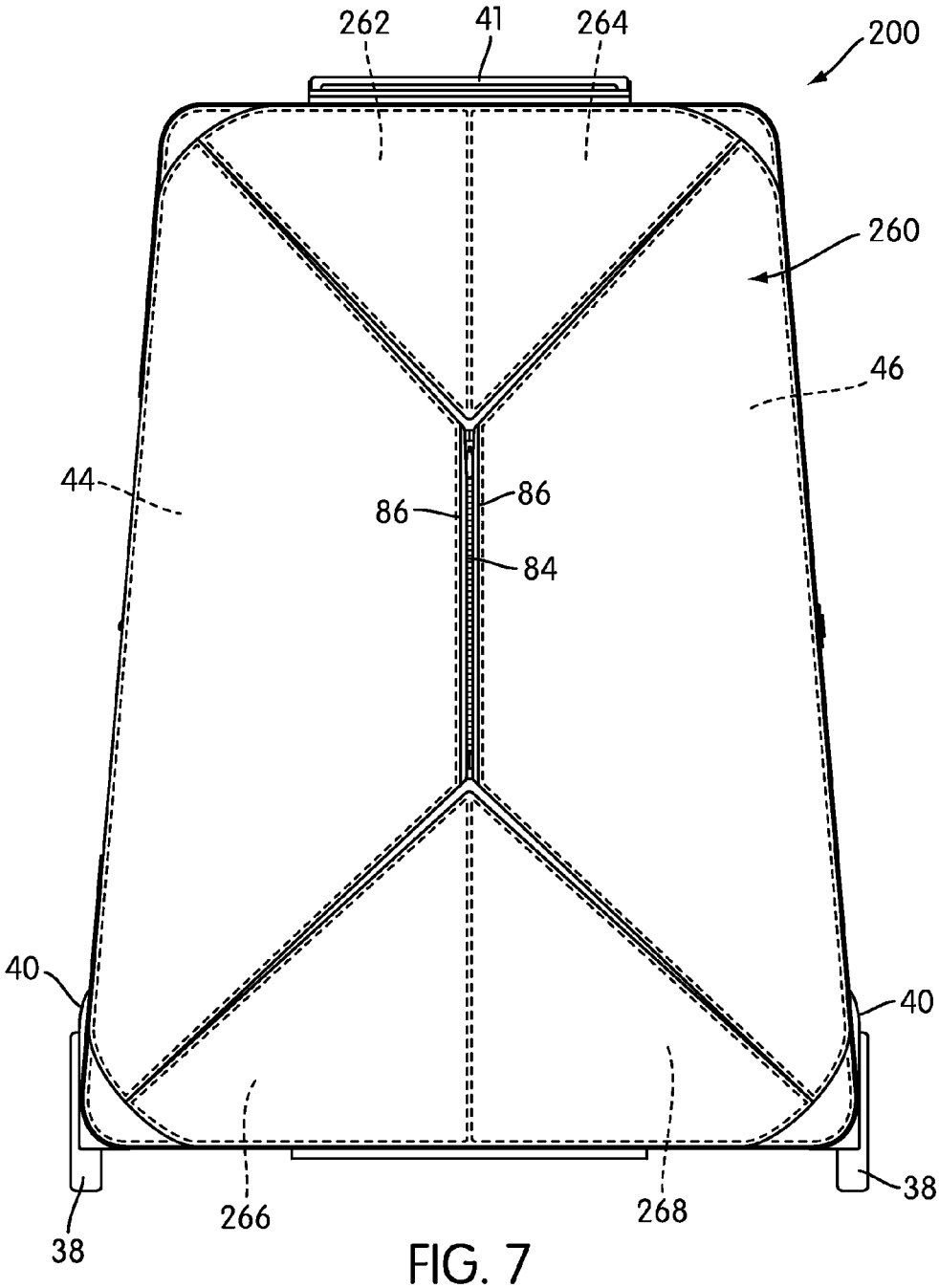
FIG. 7 is a front elevational view of the piece of collapsible luggage, illustrating the reinforcing plates of the cover according to another embodiment.
Figure 8:
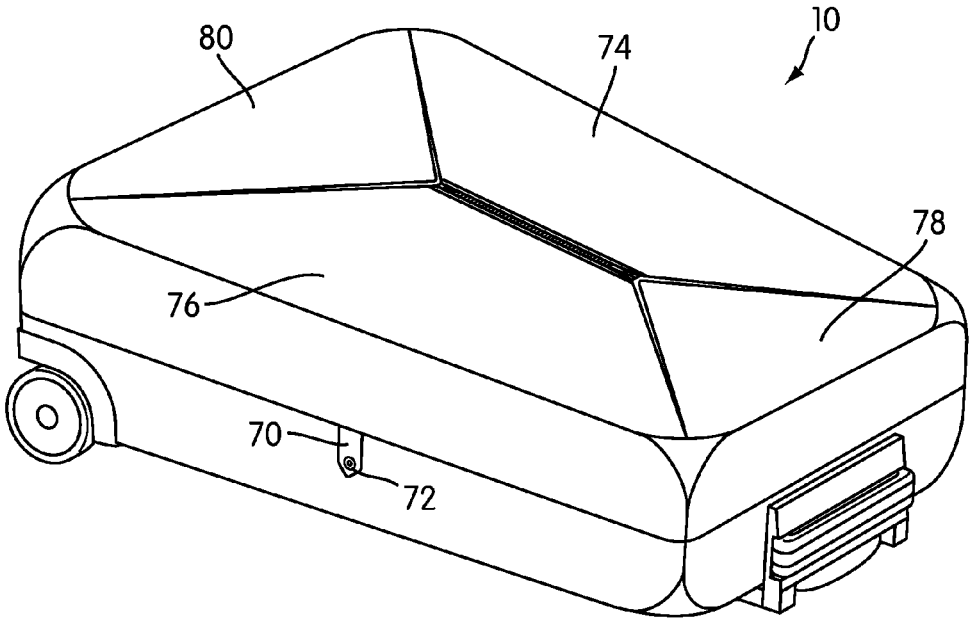
FIGS. 8-11 are successive perspective views of the piece of collapsible luggage of FIG. 1, illustrating the process of collapsing it.

Of course, in some alternate embodiments, the reinforcing plates may be subdivided, instead of being provided with living hinges. FIG. 7 is a front elevational view of a piece of luggage 200 according to one of these alternate embodiments, illustrating a cover 260. The cover 260 has left and right trapezoidal reinforcing plates 44, 46 similar to those in the cover 26. However, instead of unitary, larger upper and lower triangular plates 48, 50, the cover 260 has an individual, subdivided set of upper plates 262, 264 and an individual, subdivided set of lower plates 266, 268. The layers of fabric that the plates 262, 264, 266, 268 reinforce act as hinges. The concept illustrated by the cover 260 of FIG. 7 may be applied to other portions of the reinforcing structure as appropriate.

With respect to the piece of luggage 10, reinforcing plates are also provided in the sides of the cover 26. Two of the reinforcing plates, the upper plate 56 and the left side plate 58, are visible in the view of FIG. 5 and the bottom plate 60 is partially visible. However, the right side of the piece of luggage is a mirror image of the left side, at least insofar as reinforcement is concerned, and the right side plate is substantially similar to the left side plate 58. The upper plate 56 and lower plate 60 also have living hinges that act as fold lines and subdivide the upper and lower plates into smaller sections. The living hinge 62 of the upper plate 56 is visible in FIG. 5.

As is illustrated in FIG. 5, the plates in the sides of the cover 26, including the upper plate 56, the lower plate 60, and the two side plates 58, have upper corners with radii of curvature such that the corners curve down to a width equal to about half the width of the plate. On the lower half, they have generally straight edges. Therefore, the plates 56, 58, 60 abut each other along their lower halves, but have rounded corners along their upper halves that allow sufficient space between respective reinforcing plates for the cover 26 to fold.

Whereas the cover 26 has individual reinforcing plates 44, 46, 48, 50, 56, 58, 60, the reinforcing structure is different in the bottom of the piece of luggage 10. The sidewall 14 and bottom panel 12 are reinforced by unitary left and right three-dimensional reinforcing structures 64, 66 that reinforce the sidewall 14 and bottom panel 12 and also reinforce the corners of the piece of luggage 10. The right side reinforcing structure 66, which is shown only partially in the view of FIG. 5, is a mirror image of the left side reinforcing structure 64; thus a description of one of the reinforcing structures 64, 66 will suffice to describe both.

As shown in FIG. 5, the left side reinforcing structure 64 extends along substantially the entirety of the left sidewall portion 16 and makes approximately a 90-degree angle to extend into the bottom panel 12. In the bottom panel 12, the reinforcing structure 64 extends almost to the location of rigid portion 34. The reinforcing structure 64 also extends into the upper sidewall portion 20 and the lower sidewall portion 22, terminating on the diagonal in both of those sidewall portions 20, 22 after a short distance.

Figure 14:
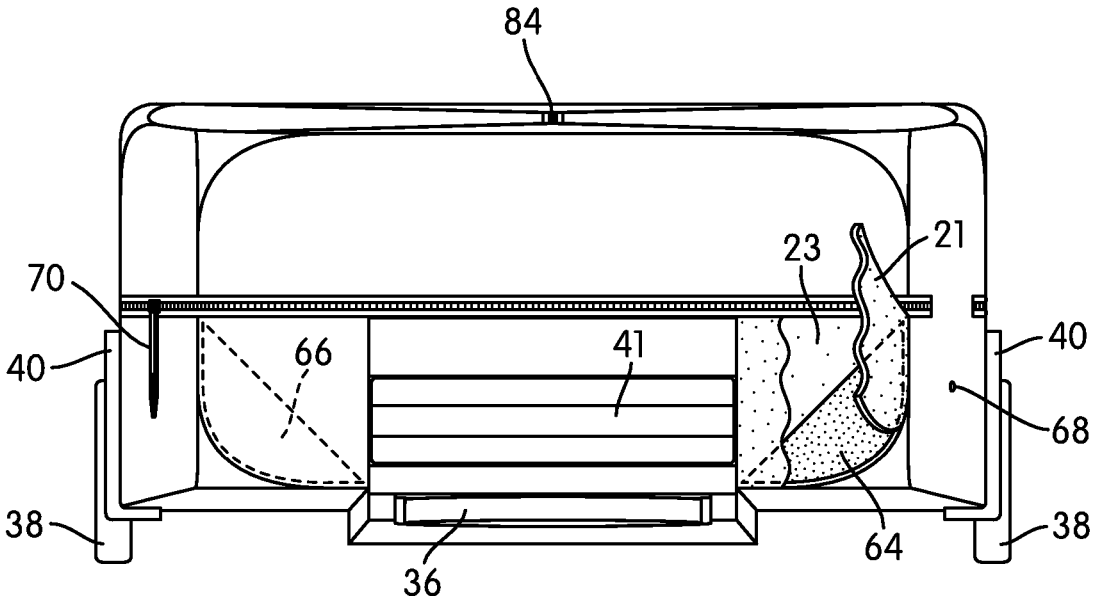
FIG. 14 is a top view of the piece of collapsible luggage of FIG. 1, illustrating some of the layers of material that the comprise the piece of luggage.

FIG. 14 is top view of the piece of collapsible expanding luggage 10 illustrating the arrangement of the reinforcing structure 64 within the upper sidewall portion 20. In the view of FIG. 14, an upper layer of flexible material 21 is cut away to show the reinforcing structure 64 beneath it. Also shown is the inner layer of flexible material 23 on the other side of the reinforcing structure 64. Specifically, as was described above, the reinforcing structure 64 terminates on the diagonal, leaving a generally triangular portion of the two layers of flexible material 21, 23 that is capable of flexing and folding when the luggage 10 is folded into its storage configuration, as will be described below in more detail. The arrangement around the other reinforcing structure 66 is a mirror image of the arrangement around reinforcing structure 64, although for the sake of simplicity in illustration, it is not shown in FIG. 14.

Other configurations of reinforcing structures may be used in other embodiments of the invention. Moreover, as was noted above, if a relatively rigid material is used for the piece of luggage 10, it may not be necessary to add separate reinforcing structure. However, even if there is no separate reinforcing structure, living hinges, thinned portions, or other types of fold-enabling structure could be provided in generally the same locations as shown in FIGS. 5-7.

Figure 9:
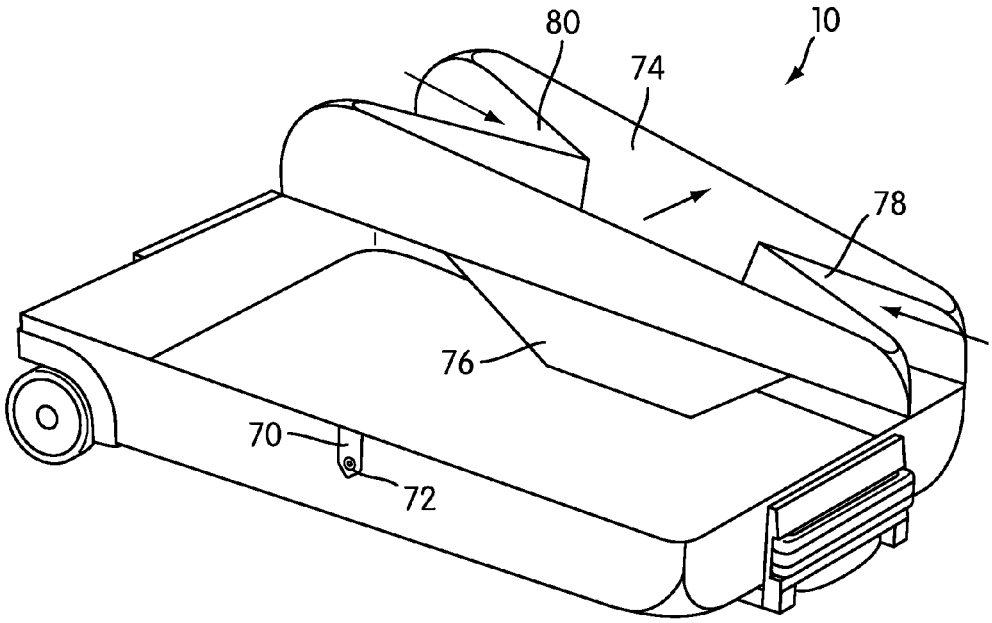

The folding sequence and storage configuration are shown in FIGS. 8-11, which are successive perspective views of the piece of luggage 10 as it is folded. In order to fold the piece of luggage 10 into the storage configuration, the user first begins with the main zipper 30 unzipped. Then, by application of manual pressure, the user causes the cover 26 to fold along its fold lines, such that the upper and lower triangular portions 78, 80 of the cover 26 fold toward the center of the cover 26 and the two trapezoidal sections 74, 76 of the cover 26 fold down, out of the plane of the cover 26, as shown in FIG. 9. Thus, the cover 26 is essentially collapsed against the left sidewall portion 16 of the piece of luggage 10.

Figure 10:
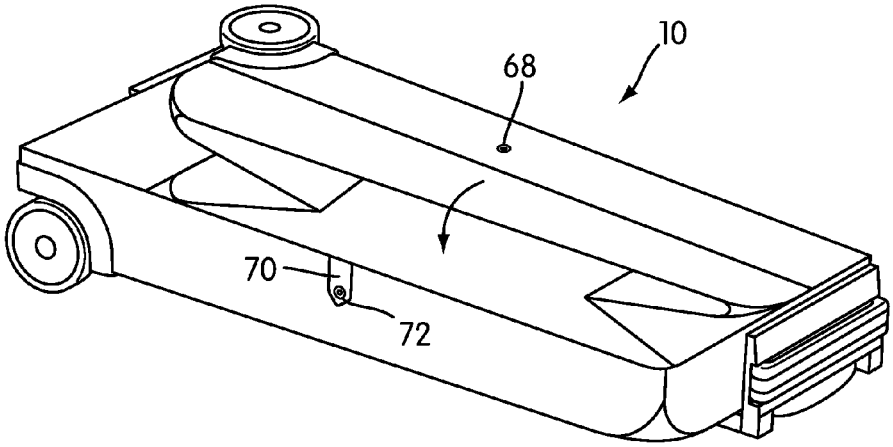

Next, as shown in FIG. 10, the left sidewall portion 16 and the part of the bottom panel 12 that is backed by the left reinforcing structure 64 fold inwardly, toward the center of the piece of luggage 10 and into the bottom of the piece of luggage 10.

Figure 11:
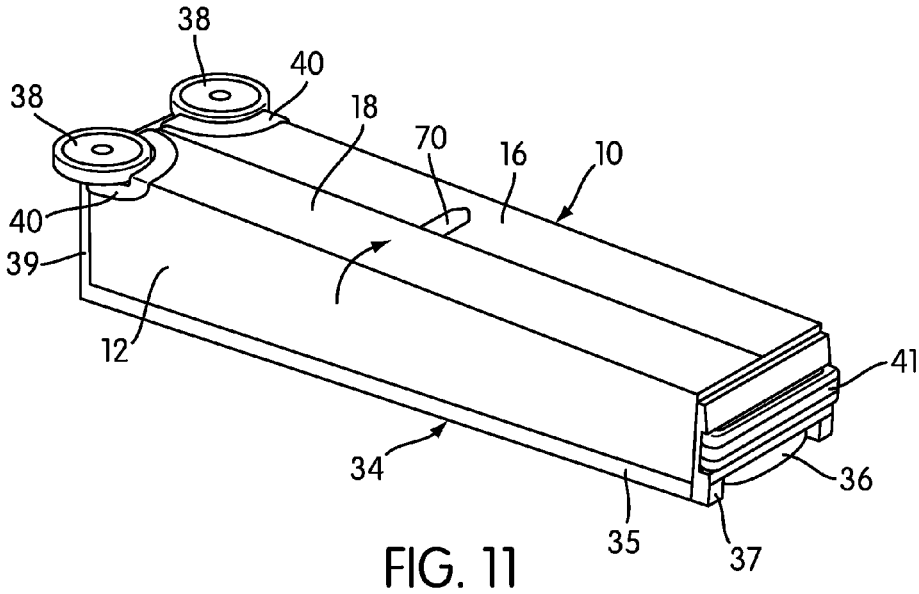

To complete the sequence, the right sidewall portion 18 and the part of the bottom panel 12 that is backed by the right reinforcing structure 66 fold inwardly toward the center of the piece of luggage. The final, folded storage configuration is illustrated in FIG. 11. As can be seen in FIG. 11, the piece of luggage 10 is folded into an area and a volume defined by the rigid portion 34. The bottom panel 12 becomes the side of the piece of luggage 10 in the storage configuration, and the left and right sidewall portions 16, 18 become the front of the piece of luggage 10 in the storage configuration. In the illustrated embodiment, the storage configuration is approximately ¼ of the volume of the piece of luggage 10 when not in the storage configuration, although the precise reduction in volume may vary from embodiment to embodiment.

Cooperating fastening structures are provided in order to retain the piece of luggage 10 in the storage configuration. In the illustrated embodiment, the fastening structures comprise a snap 68 on the left sidewall portion 16 and a strap 70 with the corresponding snap structure 72 on the right sidewall portion 18 that are brought into engaging proximity by folding the piece of luggage 10 into the storage configuration. In other embodiments, the cooperating engaging fastening structures could be respective portions of hook and loop fastener (e.g., VELCRO®) or another suitable fastening structure.

In the illustrated embodiment, the piece of luggage 10 is provided with certain reinforcing structure, including reinforcing panels 44, 46, 48, 50, 56, 58, 60 in the cover 26 and three-dimensional reinforcing structures 64, 66 along the sidewall 14 and bottom panel 12. However, in some embodiments, depending on the materials of which the piece of luggage 10 is made and the stresses to which it is to be subjected, additional reinforcing structure may be provided.

For example, in some embodiments, it may be desirable to provide additional reinforcement along the lower sidewall portion 22, specifically to reinforce the wheels 38 and to prevent them from changing position under load. Wheel reinforcement may be by means of a telescoping bar with a lock mechanism placed by a user in the interior of the piece of luggage 10 along the lower sidewall portion 22 and removed when the piece of luggage 10 is folded into the storage configuration. For example, a double rack-and-pinion system would serve well; the user would turn a central knob (the pinion), causing an upper rack and a lower rack to move outwardly, toward the left and right sidewall portions 16, 18 of the piece of luggage 10. Other reinforcing mechanisms are known in the art and may also be used. However, if the sidewall 14 is made of a sufficiently stiff material, additional reinforcement of the lower sidewall portion 22 may not be necessary.

The configuration of the cover 26 facilitates one additional feature of the piece of luggage 10, which may be included in a piece of luggage irrespective of whether or not that piece of luggage has all of the features described above.

As was described above, the front panel 42 of the cover 26 is comprised of a number of geometrically-shaped segments. In the illustrated embodiment, those segments are trapezoidal and triangular. Specifically, there is a left trapezoidal cover section 74, a right trapezoidal cover section 76, an upper triangular cover section 78, and a lower triangular cover section 80. Those sections are pivotably connected to the outer edge of the front panel 42 and are connected to one another by gusset material 82 toward the interior of the front panel 42 of the cover 26.

For purposes of this description, the term "gusset material" should be interpreted broadly. For example, in one embodiment, the gusset material 82 could be fabric sewn to the inner edges of the respective sections 74, 76, 78, 80. The gusset material 82 may or may not be made of the same material of which the rest of the front panel 42 is made. For example, if the sections 74, 76, 78, 80 are made of ballistic nylon, the gusset material 82 could be made of CORDURA® nylon. The gusset material 82 could also have properties that are different than those of the sections 74, 76, 78, 80; for example, it could be made of an elastic or somewhat elastic material, particularly if the sections 74, 76, 78, 80 are made of a relatively inelastic material like nylon. The gusset material 82 could also be made thinner than the sections 74, 76, 78, 80 it connects. However, in other embodiments, the gusset material 82 may not be a separate fabric or material. Instead, the gusset material 82 may comprise thin, flexible contiguous segments of the same material of which the sections 74, 76, 78, 80 are made.

With the arrangement described above, the front panel 42 of the cover 26 is capable of assuming two configurations: an unexpanded configuration and an expanded configuration. In the unexpanded configuration, the sections 74, 76, 78, 80 are generally co-planar. In the expanded configuration, the sections 74, 76, 78, 80 are non-coplanar and project outwardly so as to add to the storage volume of the piece of luggage 10.

Figure 12:
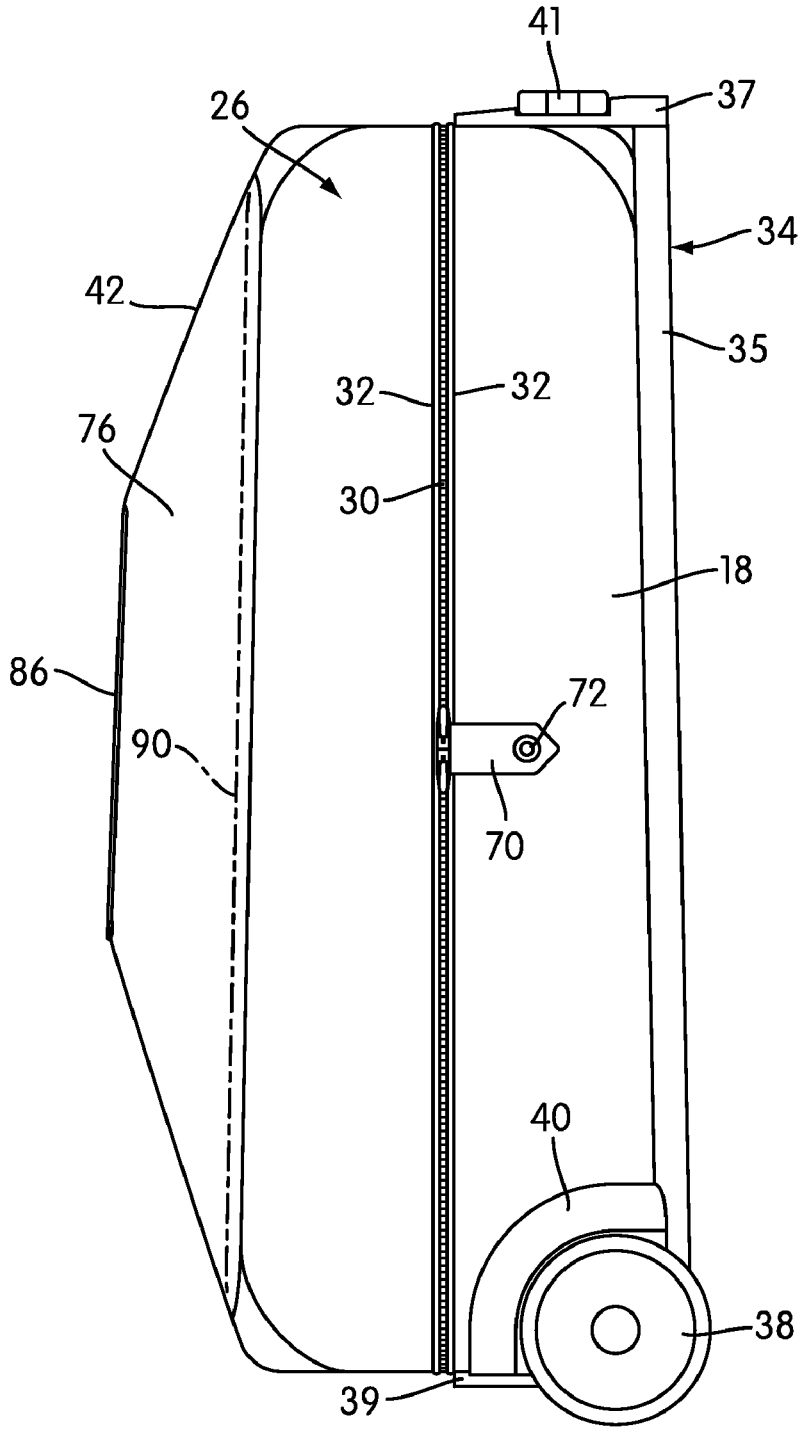
FIG. 12 is a side elevational view of the piece of collapsible luggage of FIG. 1, illustrating the expansion of the expansion panel.
Figure 13:
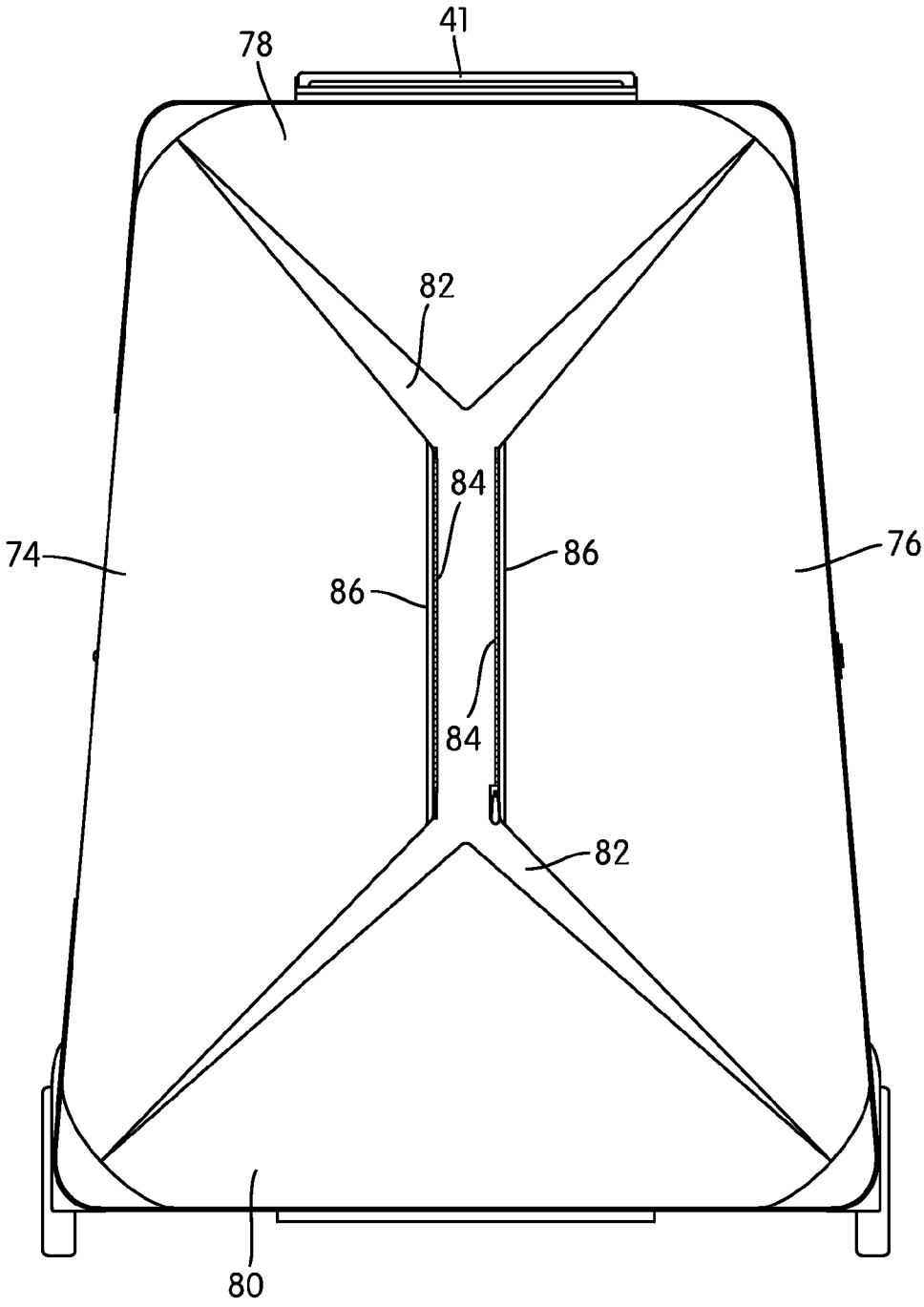
FIG. 13 is a front elevational view of the piece of collapsible luggage of FIG. 1, illustrating its expansion panel in an expanded configuration.

The expanded configuration of the cover 26 is shown in FIG. 12, a side elevational view, and in FIG. 13, a front elevational view. As can be seen in FIG. 12, in the illustrated embodiment, the sections 74, 76, 78, 80 assume a generally pyramidal shape when in the expanded configuration. However, it should be understood that the sections 74, 76, 78, 80 may have other shapes, and the cover 26 may thus have a different shape in the expanded configuration. In general, in the expanded configuration, the height of the cover 26 is not constant across the entire area of the cover 26.

The gusset material 82 provides the extra material for the front panel 42 of the cover 26 to expand. However, as is shown in the figures, a cover zipper 84 is provided between the inner edges of the left and right trapezoidal sections 74, 76 that, when engaged, constraints the extra gusset material 82 so that it is stowed, folded or stuffed, in the space beneath the cover zipper 84 and prevents the two trapezoidal sections 74, 76 from moving. When the cover zipper 84 is engaged, the cover 26 is thus prevented from assuming the expanded configuration. When the cover zipper 84 is disengaged, the cover can assume the expanded configuration. The cover zipper 84 itself may be concealed by fabric piping 86 or other concealing features.

The provision of excess gusset material 82 and a cover zipper 84 to constrain the cover 26 may not be necessary in all embodiments. For example, if the gusset material 82 is an elastic material, the cover 26 may be biased by the elastic gusset material 82 to remain in the unexpanded configuration unless objects are placed in the piece of luggage 10 that force the cover 26 into the expanded configuration.

In FIG. 12, the side elevational view of the piece of luggage 10 with the cover 26 in the expanded configuration, the extent of the unexpanded configuration is shown by the dotted line indicated by reference numeral 90. In the expanded configuration, the cover 26 may add 20-30% to the volume of the piece of luggage, depending on the sizes and shapes of the sections 74, 76, 78, 80 and the amount of gusset material 82 that is provided.

While the invention has been described with respect to certain exemplary embodiments, the description is intended to be illuminating, rather than limiting. Modifications and changes may be made within the scope of the following claims.

What is claimed is:

1. A piece of luggage comprising:

a bottom panel having at least one rigid portion;

left, right, upper, and lower sidewall portions connected to one another so as to form a generally contiguous sidewall connected to the bottom panel and extending outwardly therefrom, the sidewall having sufficient rigidity to hold its own shape and, with the bottom panel, defining a storage volume;

a cover sized to cover and close the storage volume defined by the sidewall and bottom, the cover being attached to at least one of the sidewall portions so as to be movable between an open position, in which the storage volume can be accessed, and a closed position, in which the storage volume is closed;

an extendable and retractable handle provided within the at least one rigid portion of the bottom panel and connected thereto, the handle being movable between an extended position, in which the handle extends beyond the at least one rigid portion, and a retracted position, in which the handle is substantially within the at least one rigid portion; and one or more wheels attached to the exterior of the lower sidewall portion or the bottom panel;

the cover, sidewall, and bottom panel having fold lines in predefined positions such that the piece of luggage can be folded into a storage configuration in which the sidewall, the cover, and portions of the bottom panel are folded into an area defined by the at least one rigid portion of the bottom panel.

2. The piece of luggage of claim 1, wherein the left, right, upper, and lower portions of the sidewall each comprise one or more layers of flexible material and one or more pieces of semi-rigid material secured to the one or more layers of flexible material.

3. The piece of luggage of claim 2, wherein the fold lines comprise sections of flexible material between adjacent pieces of semi-rigid material.

4. The piece of luggage of claim 2, wherein the fold lines comprise living hinges in the pieces of semi-rigid material.

5. The piece of luggage of claim 1, wherein the left, right, upper, and lower portions of the sidewall each comprise a semi-rigid material.

6. The piece of luggage of claim 5, wherein the fold lines comprise living hinges in the pieces of semi-rigid material.

7. The piece of luggage of claim 1, wherein the piece of luggage, when in the storage configuration, is smaller in width and in depth than the piece of luggage when not in the storage configuration.

8. The piece of luggage of claim 1, further comprising respective left and right substantially rigid three-dimensional reinforcing structures that reinforce at least part of the bottom panel, at least some of the sidewall portions, and corners of the piece of luggage, the reinforcing structures being hingedly mounted such that they allow the reinforced parts of the bottom panel and reinforced sidewall portions to fold into the area defined by the rigid portion.

9. A piece of luggage comprising:

a bottom panel having at least one rigid portion;

left, right, upper, and lower sidewall portions connected to one another so as to form a generally contiguous sidewall connected to the bottom panel and extending outwardly therefrom, the sidewall having sufficient rigidity to hold its own shape and, with the bottom panel, defining a storage volume; and a cover sized to cover and close the storage volume defined by the sidewall and bottom, the cover being attached to at least one of the sidewall portions so as to be movable between an open position, in which the storage volume can be accessed, and a closed position, in which the storage volume is closed, the cover including a plurality of geometrically-shaped segments pivotably connected to outer edges of the cover and connected to one another by gusset material toward the interior of the cover such that the cover is capable of assuming two configurations, an unexpanded configuration in which the geometrically-shaped segments are all generally coplanar, and an expanded configuration in which the geometrically-shaped segments are non-coplanar and project outwardly so as to add to the storage volume, the cover being generally pyramidal in the expanded configuration;

the cover, sidewall, and bottom panel having fold lines in predefined positions such that the piece of luggage can be folded into a storage configuration in which the sidewall, the cover, and portions of the bottom panel are folded into an area defined by the at least one rigid portion of the bottom panel.

10. The piece of luggage of claim 9, further comprising:

an extendable and retractable handle provided within the at least one rigid portion of the bottom panel and connected thereto, the handle being movable between an extended position, in which the handle extends beyond the at least one rigid portion, and a retracted position, in which the handle is substantially within the at least one rigid portion; and one or more wheels attached to the exterior of the lower sidewall portion or the bottom panel.

11. The piece of luggage of claim 9, wherein the geometrically-shaped segments are selected from the group consisting of generally trapezoidally-shaped segments and generally triangularly-shaped segments.

12. The piece of luggage of claim 11, wherein the geometrically-shaped segments of the cover comprise one or more upper triangular segments, one or more lower triangular segments, a left lateral trapezoidal segment, and a right lateral trapezoidal segment, inner edges of the segments toward the interior of the cover being connected by the gusset material.

13. A piece of luggage comprising:

a bottom panel;

left, right, upper, and lower sidewall portions connected to one another so as to form a generally contiguous sidewall connected to the bottom panel and extending outwardly therefrom, the sidewall and bottom panel defining a storage volume; and a cover sized to cover and close the storage volume defined by the sidewall and bottom, the cover being attached to at least one of the sidewall portions so as to be movable between an open position, in which the storage volume can be accessed, and a closed position, in which the storage volume is closed, the cover including a plurality of geometrically-shaped segments pivotably connected to outer edges of the cover and connected to one another by gusset material toward the interior of the cover such that the cover is capable of assuming two configurations, an unexpanded configuration in which the geometrically-shaped segments are all generally coplanar, and an expanded configuration in which the geometrically-shaped segments are non-coplanar and project outwardly so as to add to the storage volume;

wherein the geometrically-shaped segments of the cover comprise one or more upper triangular segments, one or more lower triangular segments, a left lateral trapezoidal segment, and a right lateral trapezoidal segment, inner edges of the segments toward the interior of the cover being connected by the gusset material.

14. The piece of luggage of claim 13, further comprising:

a rigid portion attached to the exterior of the bottom panel;

an extendable and retractable handle provided within the rigid portion and connected thereto, the handle being movable between an extended position, in which the handle extends beyond the at least one rigid portion, and a retracted position, in which the handle is substantially within the at least one rigid portion; and one or more wheels attached to the exterior of the lower sidewall portion or the bottom panel.

15. The piece of luggage of claim 13, wherein the cover is generally pyramidal in the expanded configuration.

16. The piece of luggage of claim 13, wherein the geometrically-shaped segments and the gusset material are configured and arranged such that when the cover is in the expanded configuration, the storage volume is increased from about 20% to about 30%.

17. A piece of luggage comprising:

a bottom panel having at least one rigid portion;

left, right, upper, and lower sidewall portions connected to one another so as to form a generally contiguous sidewall connected to the bottom panel and extending outwardly therefrom, the sidewall having sufficient rigidity to hold its own shape and, with the bottom panel, defining a storage volume; and a cover sized to cover and close the storage volume defined by the sidewall and bottom, the cover being attached to at least one of the sidewall portions so as to be movable between an open position, in which the storage volume can be accessed, and a closed position, in which the storage volume is closed;

the cover, the sidewall, and the bottom panel being constructed and arranged relative to one another to fold such that the piece of luggage can be folded into a storage configuration in which the sidewall and the cover fit into an area defined by the at least one rigid portion of the bottom panel, and portions of the bottom panel adjacent the at least one rigid portion fold relative to the at least one rigid portion so as to become sidewalls of the storage configuration;

wherein substantially the entire bottom is essentially rigid in the storage configuration.

18. The piece of luggage of claim 17, further comprising:

an extendable and retractable handle provided within the at least one rigid portion of the bottom panel and connected thereto, the handle being movable between an extended position, in which the handle extends beyond the at least one rigid portion, and a retracted position, in which the handle is substantially within the at least one rigid portion; and one or more wheels attached to the exterior of the lower sidewall portion or the bottom panel.

19. The piece of luggage of claim 17, further comprising respective left and right substantially rigid three-dimensional reinforcing structures that reinforce at least part of the bottom panel, at least some of the sidewall portions, and corners of the piece of luggage, the reinforcing structures being mounted such that they allow the reinforced parts of the bottom panel and reinforced sidewall portions to fold relative to the rigid portion.

20. The piece of luggage of claim 17, wherein the rigid portion comprises approximately the central one-third of the bottom panel.

* * * * *